United States Patent [19]

Orlando et al.

[11] 3,984,728

[45] Oct. 5, 1976

[54] IMAGE INTENSIFIER TUBE GATING CIRCUIT

[75] Inventors: Carl Orlando, New Shrewsbury; Vincent W. Ball, Interlaken, both of N.J.

[73] Assignee: The United States of America as represented by the Secretary of the Army, Washington, D.C.

[22] Filed: May 30, 1975

[21] Appl. No.: 582,544

[52] U.S. Cl. ..... 315/360; 250/213 A; 250/213 VT

[51] Int. Cl.[2] ..... H01J 31/50

[58] Field of Search ..... 315/363; 328/2; 250/213 A, 213 VT

[56] References Cited

UNITED STATES PATENTS

| | | | |
|---|---|---|---|
| 3,350,600 | 10/1967 | Hannan | 250/213 VT X |
| 3,619,622 | 11/1971 | Pfeiffer et al. | 250/213 VT |
| 3,689,770 | 9/1972 | Dion | 250/213 R X |
| 3,864,595 | 2/1975 | Lawrence et al. | 250/213 VT X |
| 3,903,451 | 9/1975 | Hall et al. | 250/213 VT X |

*Primary Examiner*—James B. Mullins
*Attorney, Agent, or Firm*—Nathan Edelberg; Daniel D. Sharp; Sheldon Kanars

[57] ABSTRACT

A gating circuit for use with an image intensifier tube which allows the tube to be turned on and off without producing residual image distortions, and when the tube is off eliminates scintillations on the image screen. The gating circuit provides for direct voltage control with the voltage across the cathode, anode, and the focusing electrodes of the image intensifier tube. The circuit includes a pair of triode vacuum tubes coupled together by a voltage divider network with an RC timing circuit controlling one tube which in turn acts as the bias and control of the other tube for turning the device on and off. The gating circuit is especially useful when utilizing an image intensifier tube in conjunction with photographic film which is time exposed to reproduce an image on the intensifier tube such that switching the tube on and off will not cause deleterious defocusing effects resulting in distortions on the photographic film. When the tube is off, scintillations which would reduce the quality of any photograph of the image will not be present because no voltage exists across the tube cathode and anode.

6 Claims, 1 Drawing Figure

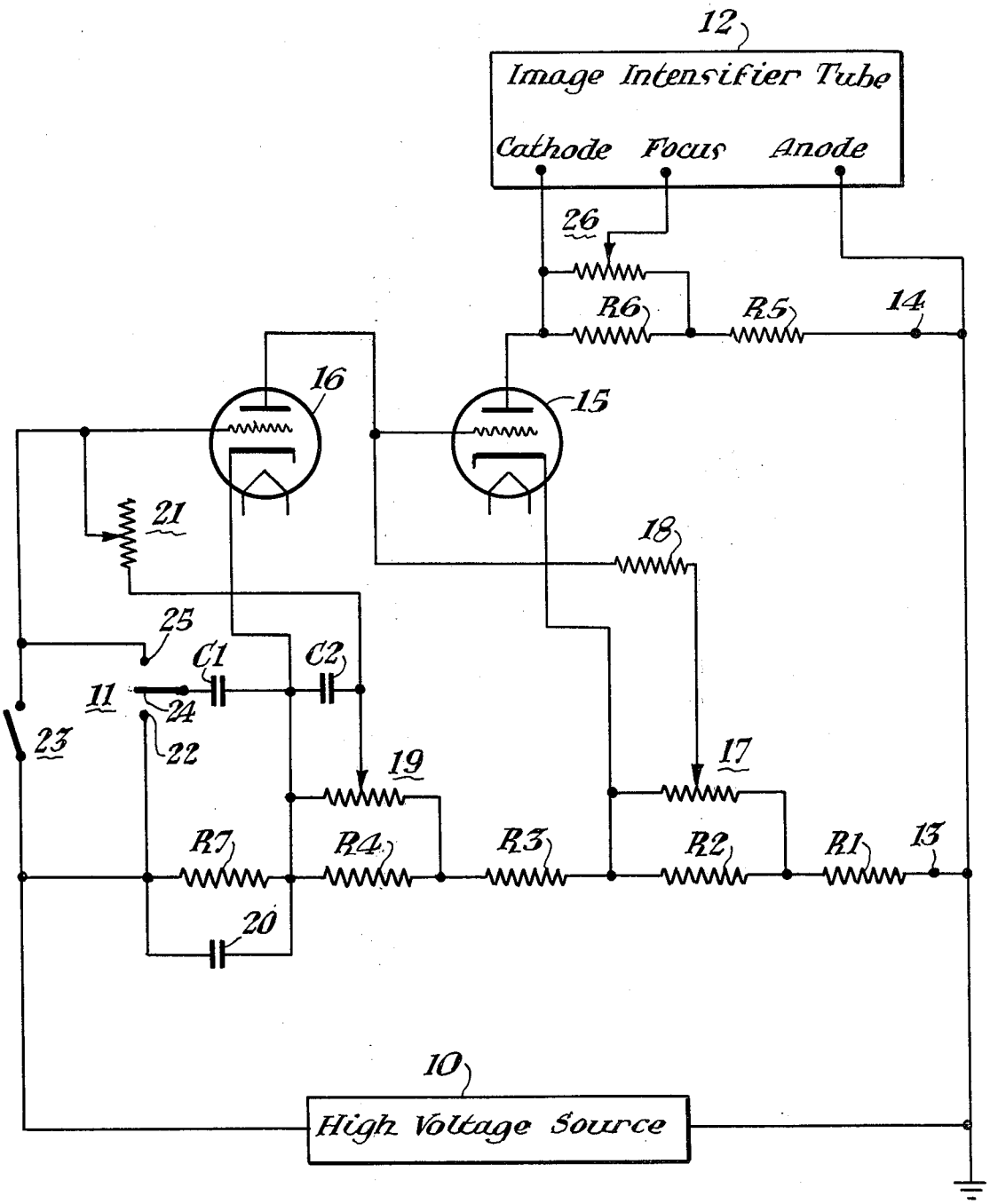
12
Image Intensifier Tube
Cathode
Focus
Anode
26
R6
R5
14
16
15
21
18
25
C1
C2
11
24
22
23
19
17
R7
R4
R3
R2
R1
13
20
10
High Voltage Source

IMAGE INTENSIFIER TUBE GATING CIRCUIT

The invention described herein may be manufactured and used by or for the Government for governmental purposes without the payment of any royalties thereon or therefor.

BACKGROUND OF THE INVENTION

This invention relates generally to an electronic switching circuit and more specifically to a switching or gating circuit which is to be utilized with an image intensifier tube, a CRT type device which produces a visual image on a phosphorous screen.

In the past, image intensifier tubes were controlled in an on or off posture by various gating circuits which switched the polarity of the tube focusing electrodes from a plus potential (about 350 volts) to a minus potential (about −1300 volts) with respect to the tube cathode. This required a switching circit capable of handling voltage in the magnitude of 1600 to 1800 volts which can be switched using a high number of high number of high voltage solid state controlled rectifiers connected in series with appropriate voltage equalizers. Utilizing the focusing anode for switching the tube image on and off creates a defocusing affect on the image because of the time constant required for the switching circuit to reach equilibrium to produce the required biasing voltage between the cathode and the focusing electrodes. The defocusing affect on the image is detrimental to the image quality, especially if the image is to be recorded on a photographic sensitive film. It is oftentimes desirous to expose the image on the tube over a period of time to sensitive photographic film such that any defocusing or scintillations when the tube is biased off could make the film exposure very distorted. Scintillations occur while the tube image is biased off from spurious electrode flow resulting from high voltage present between the tube cathode and anode which cause uncontrollable random bright spots on the tube phosperous surface. Also when the tube is in the off position, the tube image face cannot be made completely dark. Thus overall the use of image tube focusing electrodes for switching tube image on and off has in the past created deleterious affects if the tube is used in conjunction with photographic sensitive film.

The instant invention eliminates the problems of the prior art by providing a gating circuit which controls the voltage across the cathode and anode of the image intensifier tube, thus switching the device completely on or completely off while eliminating the defocusing effect and scintillations found in the prior art.

BRIEF DESCRIPTION OF THE INVENTION

A gating circuit including a pair of coupled vacuum electron tubes; the tubes being coupled to a voltage divider network, a high voltage supply and the image tube. One of the tubes is connected to the cathode and anode leads of the image intensifier tube such that when the tube is conducting, voltage is supplied across the cathode and anode, thus turning the device on. A high voltage supply necessary for driving the image intensifier tube is connected across the divider network and both tubes to provide 10 to 20 thousand volts to the intensifier cathode and anodes when the first electron tube is biased conductive. The conductivity of the first tube is controlled by the second tube and a RC timed discharge network coupled to the second tube by a switch. When the switch is actuated, a capacitor, which is normally charged when the second electron tube is conducting, discharges causing the second tube to be biased negatively shutting off the second tube, which when non-conducting positively biases the first tube causing it to conduct. When the first tube is in a conductive state, the high voltage source is coupled to the cathode and anode in the image intensifier, the time of conduction varying with the discharge period of the RC capacitor. A variable resistor is connected in the RC network such that the on time with the image intensifier tube may then be adjusted. After the control capacitor in the RC network has discharged, the second tube will then become again conductive and the first tube will be biased negative, shutting off conductivity and turning off voltage between the cathode and the anode of the image intensifier itself. The voltage divider network provides the proper voltage values to both the first and second electron tubes to establish the proper biasing of the particular conditions desired.

It is an object of this invention to provide an improved image intensifier tube gating circuit.

It is another object of this invention to provide a gating circuit for an image intensifier tube which eliminates deleterious defocusing which affects image quality and scintillation.

And yet still another object of this invention is to provide a gating circuit for use to control a high voltage source across the cathode and anode of an image intensifier tube to turn the tube on and off without producing transitional defocusing of the image tube.

But still yet another object of this invention is to provide a gating circuit for use with an image intensifier tube which does not employ voltage control of the focusing electrodes of the image intensifier tube for actuation of the device.

In accordance with these and other objects which will be apparent hereinafter, the instant invention will now be described with particular reference to the accompanying drawings.

BRIEF DESCRIPTION OF THE DRAWING

The drawing shows a schematic circuit diagram of the instant invention.

PREFERRED EMBODIMENT OF THE INVENTION

Referring now to the drawings, the gating circuit of the instant invention is shown connected to a high voltage source 10 which provides between 10 and 20 thousand volts to a conventional electro-static image intensifier tube 12 having a cathode and anode and focusing electrodes. The high voltage source 10 is connected with its output across voltage divider network branches 13 and 14. Voltage divider branch 13 is comprised of a plurality of resistors R1, R2, R3, R4 and variable resistors 17 and 19. The voltage divider branch 14 is comprised of a pair of resistors R5 and R6 in conjunction with variable resistor 26 connected across the cathode and the focusing electrodes of the image intensifier 12. Voltage divider branch 14 is connected to the plate of triode 15. The cathode of triode 15 is coupled into a portion of the voltage divider network in branch 13. The grid of triode 15 is coupled to the plate of a second triode 16. The image intensifier tube will be in an off condition when triode 15 is in a non-conductive state which is caused by a negative biasing on the grid of triode 15 which is controlled by the state of triode 16. The particular values of the resistors in branch voltage divider network 13 and the variable resistor 17 are selected to properly bias triode 15 in a non-conductive state. It can be seen that when tridode 15 is not conducting there will be no voltage or potential existing between the cathode, the anode and the focusing electrodes of image intensifier 12 and that when off, the screen will have a black image.

Triode 16 is responsible in conjunction with an RC timing network comprised of capacitor 20 and variable resistor 21 to control the conductive state of triode 15. Capacitor 20 is connected to the cathode of triode 16 through a two-position switch 11 having terminal poles 22, 24 and 25. In the normal condition, switch 11 will be closed between terminals 22 and 24. In this condition capacitor 20 is charged negatively and triode 16 is conducting. The grid of triode 15 is negatively biased due to the voltage drop across elements 16, 17 and 18 making it nonconductive. When the switch 11 is moved to close terminals 24 and 25, capacitor 20 will then discharge through resistor 21 for a particular time interval. During this time interval, the grid of triode 16 is negatively biased making triode 16 non-conductive. Whenever triode 16 is non-conductive during the time interval, the grid of triode 15 will then be positively biased causing triode 15 to conduct, providing a voltage potential between the cathode and anode of the image intensifier tube 12. Thus, image intensifier tube 12 will be in an on condition. Once capacitor 20 is completely discharged, the grid of triode 16 will become positively biased causing triode 16 to be back to the conductive state which in turn negatively biases the grid of triode 15 causing the triode to shut off and be non-conductive, thus stopping the current and the voltage potential across the cathode and anodes of the image intensifier tube 12, turning the device off.

In operation, if the image intensifier tube were used in conjunction with a photographic sensitive film such that the film would record the image on the tube face or screen, it is oftentimes desirable to control the exposure time and insure during exposure that the image not be distorted which would be recorded on the film. Thus, by controlling the variable resistor 21, which is in the RC time circuit, the amount of exposure time can be precisely controlled. When the image intensifier 12 is off (there being no voltage potential between the cathode and anode) there will be no scintillations received on the image tube screen or film. Since the focusing electrodes are not being utilized to control the on and off of the image intensifier tube, photographic sensitive film will not be subjected to defocusing effects but instead will receive a clear high quality image on the film, whenever the image intensifier is turned on and off and during the exposure process.

An auxiliary on-off switch 23 is provided if it is desirous to keep the image intensifier on continuously. When switch 11 is closed between poles 22 and 24, capacitor 20 will again be charged and the device and gating circuit will again be ready to actuate or turn on the image intensifier tube for the particular desired length of time as determined by variable resistor potentiometer 21. Additional capacitors C1 and C2 and resistor R7 are provided to insure the proper timing and biasing voltages in the network. In one embodiment, the triode 15 may be 6KB4 while triode 16 can be a 6SL7. In the instant embodiment, particular values for the circuit elements are as follows: R1, 80 megohms; R2, 1.2 megohms; R3, 0.85 megohms; R4, 0.15 megohms; R5, 68.2 megohms; R6, 1.75 megohms; resistor 26, 5 megohms; R7, 0.75 megohms; resistor 21, 5 megohms; resistor 17, 5 megohms; resistor 18, 2 megohms; capacitor 20, 0.01 microfarad; C1, 1 microfarad; C2, 10 microfarads. The circuit values indicated are those used for a specific application. These values can be changed to accommodate various applications. Triode electrode vacuum tubes were chosen for simplification in the circuit, as solid state devices would be impractical, very complex and expensive for gating the high voltages (10 to 20 thousand volts required). The circuit in its broadest embodiment is however adaptable to solid state devices. Although an electro-static focusing image intensifier tube had been utilized as an example, other similar devices, such as magnetically focused, micro-channeled and hybrid tubes may also be gated by applying the circuit of the instant invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A switching circuit for turning on and off the display on a high voltage image intensifier tube having an anode electrode, a cathode electrode and focusing means without producing defocusing effects comprising a source of high voltage having first and second terminals, said first terminal being connected to one of the electrodes of said image intensifier tube, an electron discharge device gate means inserted between said second terminal and the other electrode of said image intensifier tube and including an input circuit, said gate means normally being in a non-conducting state so that said other electrode of the image intensifier tube is disconnected from said high voltage source, an electron discharge device gate control means for said gate means which normally is biased in the conducting state, said gate control means including an output circuit coupled to the input circuit of said gate means and input circuit control means for altering the bias of said gate control means to a level at which said gate control means attains the non-conducting state, said gate means becoming conductive in response to the attainment by said gate control means of the non-conducting state, said conductive gate means providing an electrically conductive current path from said second terminal to the other electrode of said image intensifier tube and thereby applying a high voltage between the cathode and anode of said image intensifier tube.

2. A switching circuit as recited in claim 1 wherein said input circuit control means includes a time constant circuit having resistor means and a capacitor and further includes an operable switch for discharging said capacitor through said resistor means and biasing said gate control means to the non-conducting state.

3. A switching circuit according to claim 2 wherein a portion of said time constant circuit is adjustable to determine the time required to bias said gate control means to the non-conducting state and the time during which the high voltage is applied between the cathode and anode of said image intensifier tube.

4. A switching circuit according to claim 1 wherein said output circuit of said gate means includes a voltage divider network having taps thereon connected to the cathode and anode electrodes and the focusing means of said image intensifier tube, said voltage divider network having current flow therein only when said gate means is rendered conducting.

5. A switching circuit according to claim 3 wherein said output circuit of said gate means includes a voltage divider network having taps thereon connected to the cathode and anode electrodes and the focusing means of said image intensifier tube, said voltage divider network having current flow therein only when said gate means is rendered conducting.

6. A switching circuit according to claim 2 wherein said operable switch is positioned to recharge said discharged capacitor to return said gate control means to the conducting state.

* * * * *